US009532135B2

(12) United States Patent
Takeda et al.

(10) Patent No.: US 9,532,135 B2
(45) Date of Patent: Dec. 27, 2016

(54) BONE CONDUCTION SPEAKER UNIT

(71) Applicant: TEMCO JAPAN CO., LTD., Tokyo (JP)

(72) Inventors: Takeshi Takeda, Tokyo (JP); Yasuhide Terasawa, Tokyo (JP)

(73) Assignee: TEMCO JAPAN CO., LTD, Tokyo (JP)

( * ) Notice: Subject to any disclaimer, the term of this patent is extended or adjusted under 35 U.S.C. 154(b) by 0 days.

(21) Appl. No.: 14/431,854

(22) PCT Filed: Jul. 17, 2014

(86) PCT No.: PCT/JP2014/069055
§ 371 (c)(1),
(2) Date: Mar. 27, 2015

(87) PCT Pub. No.: WO2015/033677
PCT Pub. Date: Mar. 12, 2015

(65) Prior Publication Data

US 2015/0289052 A1 Oct. 8, 2015

(30) Foreign Application Priority Data

Sep. 3, 2013 (JP) ..... 2013-182141

(51) Int. Cl.
*H04R 25/00* (2006.01)
*H04R 1/46* (2006.01)
(Continued)

(52) U.S. Cl.
CPC *H04R 1/46* (2013.01); *H04R 1/02* (2013.01); *H04R 1/06* (2013.01); *H01R 24/58* (2013.01);
(Continued)

(58) Field of Classification Search
CPC ..... H04R 1/06; H04R 1/46; H04R 1/02; H04R 1/046; H04R 2499/11; H04R 2460/13; H01R 11/00; H01R 24/55
(Continued)

(56) References Cited

U.S. PATENT DOCUMENTS 6,914,996 B2 * 7/2005 Takeda ..... H04M 1/72591 381/380
7,822,220 B2 * 10/2010 Kuo ..... H04R 1/10 381/384
(Continued)

FOREIGN PATENT DOCUMENTS

JP 2000286945 A 10/2000
JP 3312902 B2 8/2002
(Continued)

*Primary Examiner* — Brian Ensey
(74) *Attorney, Agent, or Firm* — Browdy and Neimark, P.L.L.C.

(57) ABSTRACT

Problem is to provide a bone conduction speaker unit which is compact as a whole, and can be used, being simply and neatly mounted to a great variety of pieces of existing communication equipment, such as mobile phones. A unit case 1 is provided which incorporates a bone conduction speaker 2 such that a diaphragm 3 is exposed, with an earphone-jack mating plug 4, which is connected to the bone conduction speaker 2, being disposed on the unit case 1, and by connecting the plug 4 to an earphone jack 22 on a cabinet 21 of a piece of communication equipment, such as a mobile phone, the piece of communication equipment is allowed to be used as a speaker.

7 Claims, 4 Drawing Sheets

(51) Int. Cl.
*H04R 1/02* (2006.01)
*H04R 1/06* (2006.01)
*H01R 24/58* (2011.01)

(52) U.S. Cl.
CPC ..... *H04R 2460/13* (2013.01); *H04R 2499/11* (2013.01)

(58) Field of Classification Search
USPC ..... 381/326, 380; 455/550.1, 575.6
See application file for complete search history.

(56) References Cited

U.S. PATENT DOCUMENTS

| | | | |
|---|---|---|---|
| 2004/0013279 | A1 | 1/2004 | Takeda |
| 2011/0269348 | A1 | 11/2011 | Zorkendorfer et al. |

FOREIGN PATENT DOCUMENTS

| | | | |
|---|---|---|---|
| JP | 3106645 | U | 1/2005 |
| JP | 4307446 | B2 | 8/2009 |
| JP | 2012151717 | A | 8/2012 |
| JP | 2013152741 | A | 8/2013 |
| WO | 2004051967 | A1 | 6/2004 |

* cited by examiner

BONE CONDUCTION SPEAKER UNIT

TECHNICAL FIELD

The present invention relates to a bone conduction speaker unit, and more particularly, relates to a bone conduction speaker unit which can be used, being simply loaded on a piece of communication equipment, such as an existing mobile phone.

BACKGROUND ART

Most of the speakers for currently available mobile phones basically provide an apparatus which incorporates a dynamic speaker unit and an ECM microphone therein, however, it is known that, with such a combination of components, a voice from a speech opposite party is difficult to be heard in a highly noisy environment. With the microphone, incorporating a noise canceling circuit therein has brought about a certain degree of improvement, however, for a voice which is heard from a speech opposite party, there is no measure against a possible difficulty of hearing besides increasing the sound volume of the speaker. However, any currently available mobile phones offer a limitation in taking such a measure, and it is difficult to avoid occurrence of a situation in which hearing is impossible.

It is known that, for talking in a highly noisy environment, a bone conduction microphone and a bone conduction speaker can be effectively used. The bone conduction speaker unit converts a voice signal into a vibration to transmit it to the skull, and the like, and it is compact and lightweight, and is capable of being used even in a noisy environment, whereby, in recent years, it has widespread use in communication equipment, such as a mobile phone.

In the case where a bone conduction microphone and a bone conduction speaker are used with a piece of communication equipment, such as a mobile phone, these devices are used, being incorporated in a housing of the piece of communication equipment, however, this presupposes that there has previously been provided a space for loading these devices in the housing, and in such space these devices are incorporated (refer to Patent Documents 1 to 3). Accordingly, these devices cannot be used with existing general mobile phones or any other pieces of communication equipment for which these devices are not intended to be loaded therein, and thus there has been provided no space for loading them.

In order to allow a bone conduction speaker to be loaded on an existing mobile phone for use therewith, a mobile phone attachment for use by a hearing-impaired person has been proposed (refer to Patent Document 4). It is composed of a microphone which is installed in tight contact with an ear piece of a mobile phone; a bone conduction speaker which is installed so as to be abutted against a part of the head at the time of being used; a main body unit which includes an amplifier and a battery; and a fixing means for mounting said microphone, said bone conduction speaker, and said main body unit to said mobile phone.

Further, said fixing means has a telescoping part in the middle portion, further having an upper hook which forms one end portion of the fixing means, being loaded with said microphone, said bone conduction speaker, and said main body unit, and being bent to be hooked on an end face part of said mobile phone on the antenna installation side thereof, and a lower hook which forms the other end portion of the fixing means, being hooked on an end face part of said mobile phone on the charging terminal installation side thereof, and thus the type of mobile phone with which this attachment can be used is considerably limited, thereby this attachment lacking versatility. In addition, because the attachment is large as a whole, it presents a problem that, if loaded on a mobile phone, the appearance of the mobile phone is impaired.

CITATION LIST

Patent Document

Patent Document 1: WO 2004/051967A1

Patent Document 2: Japanese Unexamined Patent Application Publication No. 2012-151717

Patent Document 3: Japanese Patent Publication No. 4307446

Patent Document 4: Japanese Patent Publication No. 3312902

DISCLOSURE OF THE INVENTION

Problems to be Solved by the Invention

As described above, with a piece of communication equipment, such as a conventional mobile phone, which includes a bone conduction speaker, the bone conduction speaker is a device which is to be previously incorporated in the housing of a piece of communication equipment, being not intended to be post-installed in a piece of existing communication equipment, and with a mobile phone attachment for use by a hearing-impaired person that is loaded on an existing mobile phone to be used, there are problems that it lacks versatility and, if loaded on a mobile phone, it impairs the appearance of the mobile phone. Then, it is an object of the present invention to provide a bone conduction speaker unit which is free from such problems, in other words, is compact as a whole, and can be used, being simply and neatly mounted on pieces of communication equipment, such as a wide variety of existing mobile phones.

Means for Solving the Problems

Having been faced with the above-mentioned problems, the present inventor et al. have noted that most of the currently available mobile phones have an earphone jack serving as a socket into which the plug of an earphone or a headphone is inserted, and on the basis of an idea that, by utilizing the earphone jack, a bone conduction speaker can be simply mounted to the mobile phone main body, have achieved the present invention.

The invention according to claim 1 for solving the above problems is a bone conduction speaker unit, including a unit case, incorporating a bone conduction speaker therein with a diaphragm of the bone conduction speaker being exposed, and an earphone jack-mating plug, being disposed in said unit case and being connected to said bone conduction speaker, said plug being connected to an earphone jack in a housing of a mobile phone or other piece of communication equipment to thereby allow said bone conduction speaker unit to be used as a speaker for the piece of communication equipment.

In one embodiment, with said plug being inserted into said earphone jack, said unit case is fixed to the housing of said piece of communication equipment. Further, in one embodiment, said unit case is provided with a positioning guide for use in positioning thereof with respect to the housing of said piece of communication equipment, or said unit case is provided with an engagement means for use in engaging thereof with the housing of said piece of communication equipment.

Further, in one embodiment, said plug may be slidably provided in a bottom face of said unit case, or said plug may be provided in a bottom face of said unit case so as to be turnable from a vertical position to a horizontal one, or further, to said plug, an adapter cable with jack that has an earphone jack mating plug at the distal end may be connected.

Still further, in one embodiment, said unit case is provided with a fixing plate, opposing to an upper portion of the housing of said piece of communication equipment, and on said fixing plate, an anchoring means for anchoring thereof to the upper portion of said housing is disposed.

Advantages of the Invention

The present invention is as described above, and thus, the bone conduction speaker of the present invention is compact as a whole; can be used, being simply and neatly mounted on pieces of communication equipment, such as a wide variety of existing mobile phone; and can be easily removed when not needed, or can be replaced with a new one. In addition, the bone conduction speaker unit of the present invention offers an advantage that, when it is loaded on the housing of a mobile phone, the bone conduction speaker (the diaphragm) thereof is disposed substantially in the same location as that of the speaker of the mobile phone, thereby the bone conduction speaker can be simply and reliably disposed on the tragus of the user, and thus the voice can be most efficiently heard, the bone conduction speaker unit of the present invention providing a particularly effective and useful one when used by a conductive hearing-impaired person.

BEST MODE FOR CARRYING OUT THE INVENTION

Figure 1:
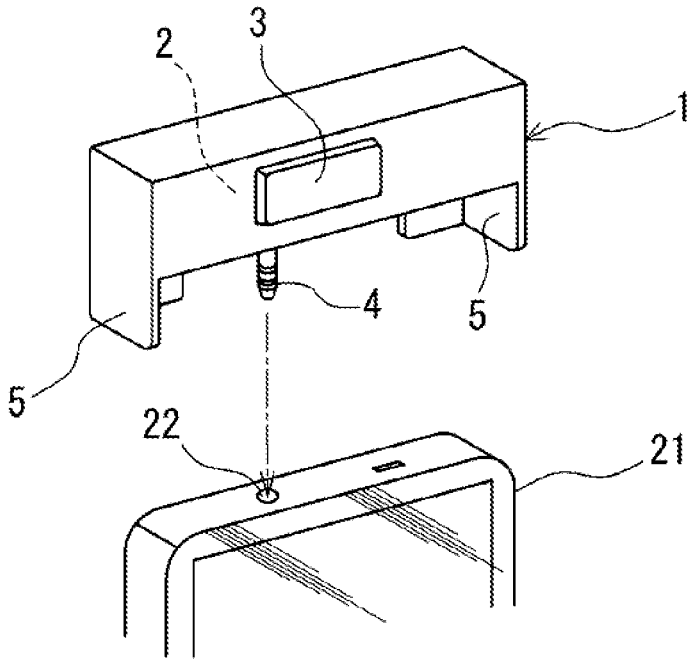
FIG. 1 is a perspective view of a bone conduction speaker unit of a first embodiment in accordance with the present invention.

Hereinbelow, embodiments of the present invention will be explained with reference to the attached drawings. FIG. 1 is a perspective view of a bone conduction speaker unit of a first embodiment in accordance with the present invention. As shown in FIG. 1, with the bone conduction speaker unit in accordance with the present invention, a unit case 1 in which a bone conduction speaker 2 is incorporated with a diaphragm 3 thereof being exposed is provided, and in the unit case 1, an earphone jack-mating plug 4, which is connected to the bone conduction speaker 2, is disposed so as to be projected from a bottom face thereof. Inside of the unit case 1, an amplifier and a battery are incorporated as needed.

In this first embodiment, by inserting the plug 4 of the bone conduction speaker unit into an earphone jack 22 in a housing 21 of a mobile phone or other piece of communication equipment which is provided with an earphone jack 22 (hereinafter, simply to be called "a piece of communication equipment"), the bone conduction speaker unit is set on the housing 21, and thus can be used as a speaker of the piece of communication equipment.

In the first embodiment, a positioning guide 5 for positioning the plug 4 with respect to the earphone jack 22 is formed in the unit case 1. The positioning guide 5 in an example shown is formed of a pair of right and left members which are extended downward from both ends of the bottom face of the unit case 1; by using the positioning guide 5 to sandwich the upper portion of the housing 21 at the side faces thereof, the plug 4 is positioned just on the earphone jack 22, and then by causing the positioning guide 5 to be lowered, the plug 4 is inserted into the earphone jack 22. The positioning guide 5 preferably has a right angle geometry in section as shown in the figure, however, may be formed of a pair of right and left or a pair of front and rear flat plate members which are abutted against both side faces or the front and rear faces of the housing 21, respectively.

Figure 2:
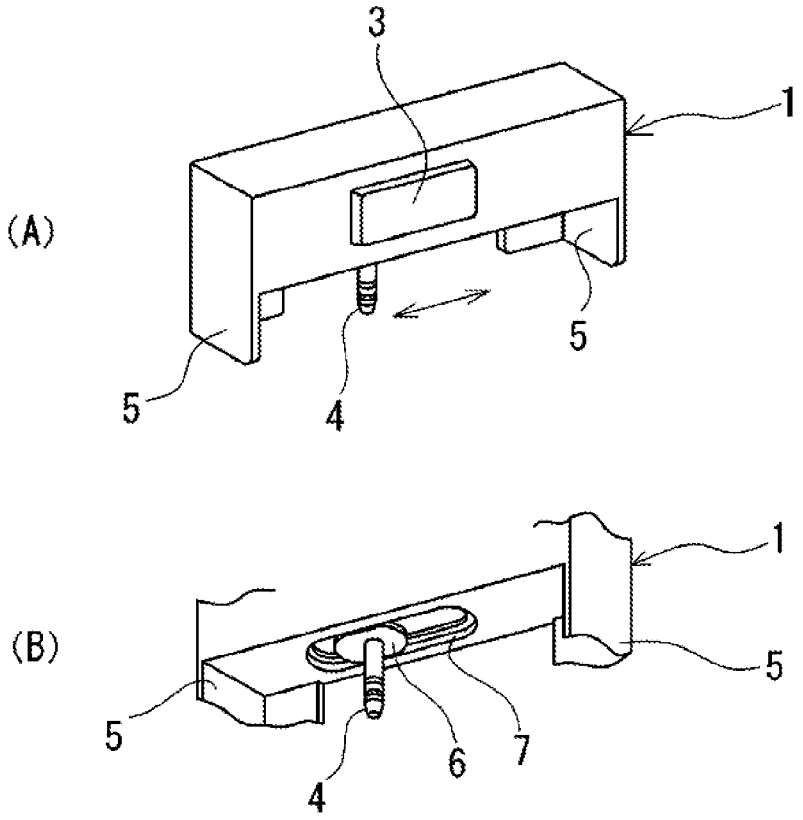
FIGS. 2A and 2B are a perspective view from the top side and the bottom side, respectively, of a bone conduction speaker unit of a second embodiment in accordance with the present invention.

The location where the earphone jack 22 is provided in the top face of the housing 21 is not always fixed, but can be varied depending upon the type of piece of communication equipment. In a second embodiment shown in FIGS. 2A and 2B, which is made in consideration of such a case, the plug 4 is provided so as to be slidable in a lateral direction with respect to the bottom face of the unit case 1. In order to make the plug 4 slidable in a lateral direction, there is provided a configuration in which the plug 4 is projected from a movable base 6, the movable base 6 being slidably locked in an elongated hole 7, which is disposed in the bottom face of the unit case 1. In this embodiment, the plug 4 is first laterally moved to the location of the earphone jack 22 in the housing 21 on which the unit case 1 is to be set, and thereafter the unit case 1 is set on the housing 21 in the same manner as described above.

Figure 3:
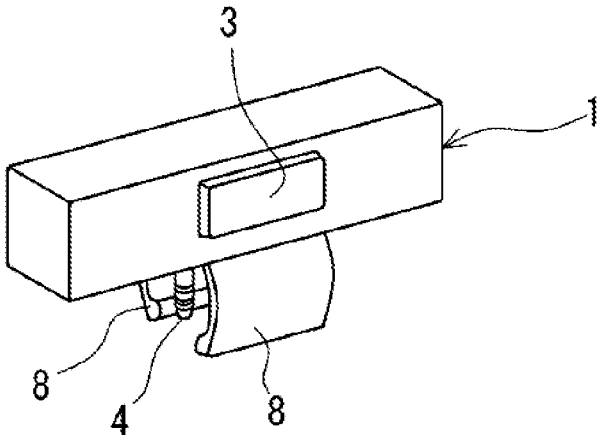
FIG. 3 is a perspective view of a bone conduction speaker unit of a third embodiment in accordance with the present invention.

In a third embodiment shown in FIG. 3, the unit case 1 is provided with an engagement means for engaging the unit case 1 with the housing 21. The engagement means in an example shown is a clip member 8 which extends from the bottom face of the unit case 1, sandwiching the upper portion of the housing 21 in a width direction. The clip member 8 has an elasticity, and is capable of slightly opened; thus by slightly opening the clip member 8 and sliding the upper portion of the housing 21 thereinto, the upper portion of the housing 21 is held by the clip member 8, being pinched with a restoring force thereof. The configuration of the plug 4 and the manner of insertion thereof into the earphone jack 22 are in accordance with the above-mentioned first and second embodiments.

Figure 4:
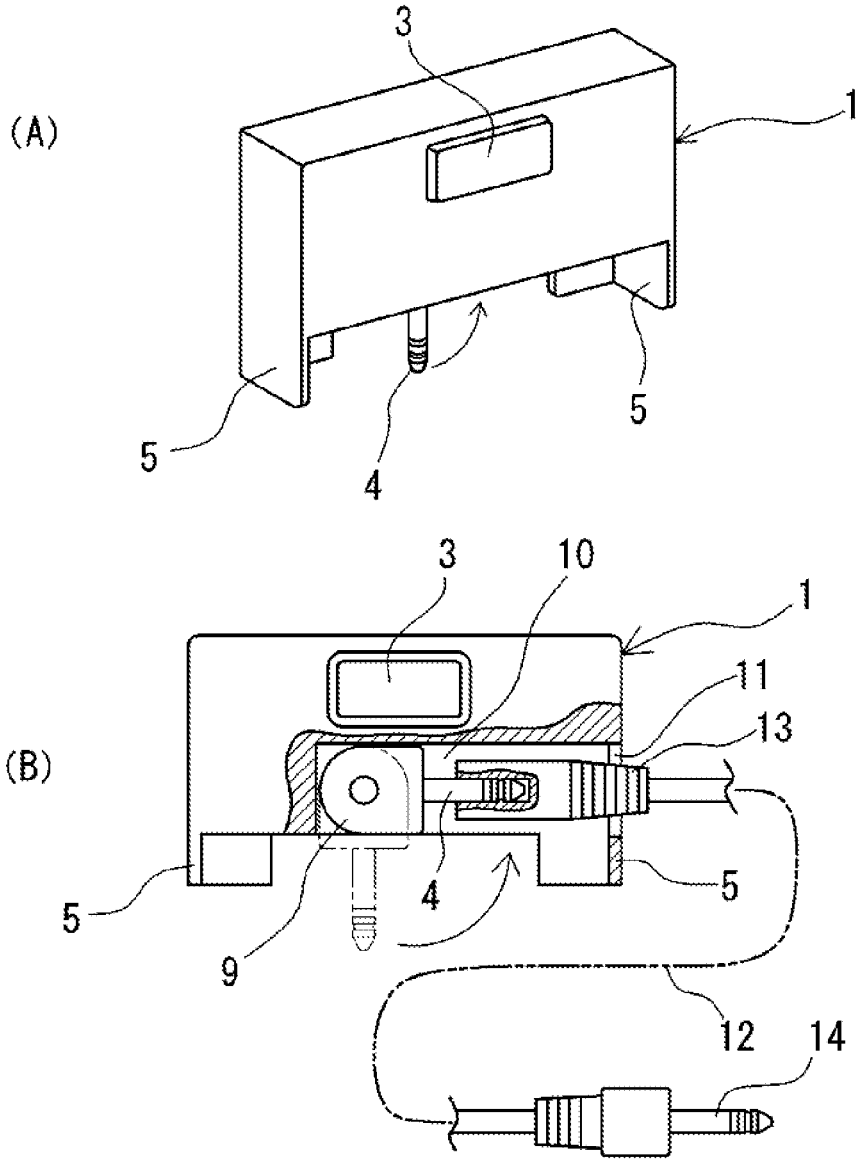
FIGS. 4A and 4B are a perspective view and a front view, with a portion broken away for the sake of clarity, of a bone conduction speaker unit of a fourth embodiment in accordance with the present invention.

In a fourth embodiment shown in FIGS. 4A and 4B, the plug 4 is provided in a turning block 9, which is turnably disposed in the lower portion of the unit case 1, and as the turning block 9 is moved, the plug 4 is turned through an angle ranging from a vertical position to a horizontal position. Further, in the bottom portion of the unit case 1, there is formed a space part 10 for housing the plug 4 which has been turned to the horizontal position. The plug 4 which has been housed in the space part 10 is connected to a jack 13 of an adapter cable 12 with jack that has been inserted from an opening 11, which is provided in the side face of the unit case 1. The adapter cable 12 with jack is provided, at the distal end, with a plug 14, which mates with the earphone jack 22.

Also in this fourth embodiment, a positioning member 5, which is the same as that in the first embodiment, is formed, and when the unit case 1 is to be loaded on a piece of communication equipment which is provided with the earphone jack 22 in the top face of the housing 21, the plug 4 is brought into the vertical position to allow the unit case 1 to be loaded on the housing 21 in the same manner as that in the first embodiment. When the unit case 1 is to be loaded on a piece of communication equipment with which the earphone jack 22 is provided in the side face of the housing 21 rather than the top face thereof, the plug 4 is turned to the horizontal position, and is inserted into the jack 13 of the adapter cable 12 with jack that is inserted from the opening 11 in the side face of the unit case 1. Then, the plug 14 of the adapter cable 12 with jack is inserted into the earphone jack 22 of the housing 21.

In this fourth embodiment, in order to stably load the unit case 1 on the top face of the housing 21, an adhesion means, such as a double-sided adhesive tape, may be interposed between the unit case 1 and the top face of the housing 21, or a means, such as a screw fastening one, may be used, as needed.

Figure 5:
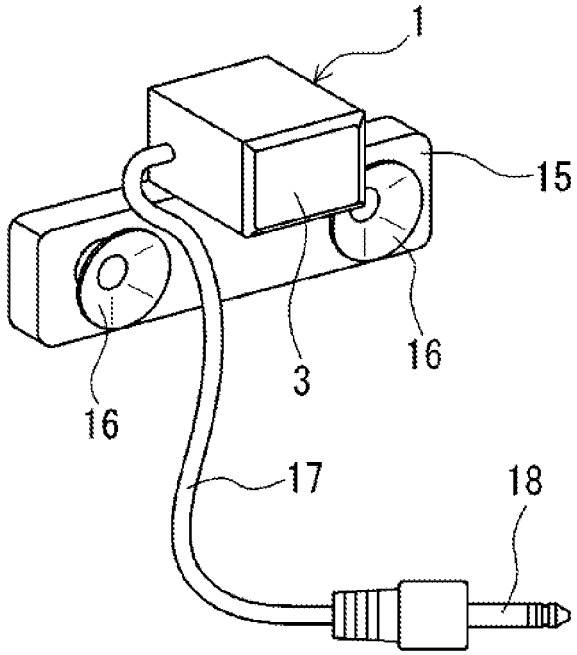
FIG. 5 is a perspective view of a bone conduction speaker unit of a fifth embodiment in accordance with the present invention.

In a fifth embodiment shown in FIG. 5, a fixing plate 15, which extends in both rightward and leftward directions, is provided on the back face or the rear face of the unit case 1, and on the side of the fixing plate 15 where it is to be abutted against the housing 21, there is provided an anchoring means for anchoring the fixing plate 15 to the upper portion of the rear face or the front face of the housing 21. The anchoring means in an example shown is a suction disk 16, however, it may be a double-sided tape, or the like. In this fifth embodiment, the unit case 1 is installed so as to rest on the top face of the housing 21, and the fixing plate 15 is fixed to the upper portion of the rear face or the front face of the housing 21 through the suction disk 16 or other anchoring means, thereby the unit case 1 being loaded on the housing 21.

In this case, a plug cable 17, which is connected to the bone conduction speaker 2, is withdrawn from the unit case 1, and the plug 18 at the distal end of the plug cable 17 is inserted into the jack 22 in the top face or the side face of the housing 21

In any of the above embodiments, the unit case 1 is loaded on the housing 21, and by inserting the plug 4, 14, or 18 into the earphone jack 22 in the housing 21, the bone conduction speaker 2 can be used as a speaker for the piece of communication equipment. In the case where the unit case 1 is to be loaded on a piece of communication equipment in which the earphone jack 22 is provided in the top face of the housing 21, the loading thereof is completed simply by inserting the plug 4 into the earphone jack 22, thereby the loading operation to be performed is extremely simple.

With general mobile phones, when the bone conduction speaker unit of the present invention is loaded on the housing thereof, the bone conduction speaker 2 (the diaphragm 3) is disposed substantially in the same location as that of the speaker of the mobile phone, thereby the bone conduction speaker 2 can be simply and reliably disposed on the tragus of the user, and thus the voice can be most efficiently heard (it is a well-known fact that, in the case where a non-handicapped person in hearing uses a bone conduction speaker, the voice can be most efficiently listened when the bone conduction speaker is disposed on the tragus.). In addition, it is known that the bone conduction speaker is extremely effective for a conductive hearing-impaired person, thereby the mobile phone which is equipped with a bone conduction speaker unit in accordance with the present invention provides a particularly effective and useful one when used by a conductive hearing-impaired person.

Hereinabove, the present invention has been explained in detail to some extent, and about the most preferred embodiment, however, since it is obvious that a wide range of different embodiments can be made without departing from the spirit and scope of the present invention, it is to be understood that the present invention is not limited to the specific embodiments thereof except as defined in the appended claims.

DESCRIPTION OF SYMBOLS

Reference numeral 1 denotes a unit case; 2 a bone conduction speaker; 3 a diaphragm; 4, 14, and 18 a plug; 5 a positioning guide; 6 a base; 7 an elongated hole; 8 a clip member; 9 a turning block; 10 a space part; 11 an opening; 12 an adapter cable with jack; 13 a jack; 15 a fixing plate; 16 a suction disk; 17 a plug cable; 21 a housing; and 22 an earphone jack.

The invention claimed is:

1. A bone conduction speaker unit, comprising a unit case, incorporating a bone conduction speaker therein with a diaphragm of the bone conduction speaker being exposed, and an earphone jack-mating plug, being disposed in said unit case and being connected to said bone conduction speaker, said plug being slidably provided in a bottom face of said unit case and being connected to an earphone jack in a housing of a mobile phone or other piece of communication equipment to thereby allow said bone conduction speaker unit to be used as a speaker for the piece of communication equipment, wherein an amplifier and a battery are incorporated in said unit case.

2. The bone conduction speaker unit according to claim 1, wherein, with said plug being inserted into said earphone jack, said unit case is fixed to the housing of said piece of communication equipment.

3. The bone conduction speaker unit according to claim 1, wherein said unit case is provided with a positioning guide for use in positioning thereof with respect to the housing of said piece of communication equipment.

4. The bone conduction speaker unit according to claim 1, wherein said unit case is provided with an engagement means for use in engaging thereof with the housing of said piece of communication equipment.

5. A bone conduction speaker unit, comprising a unit case, incorporating a bone conduction speaker therein with a diaphragm of the bone conduction speaker being exposed, and an earphone jack-mating plug, being disposed in said unit case and being connected to said bone conduction speaker, said plug being connected to an earphone jack in a housing of a mobile phone or other piece of communication equipment to thereby allow said bone conduction speaker unit to be used as a speaker for the piece of communication equipment, wherein said plug is provided in a bottom face of said unit case so as to be turnable from a vertical position to a horizontal one.

6. The bone conduction speaker unit according to claim 5, wherein, to said plug, an adapter cable with jack that has an earphone jack mating plug at the distal end is connected.

7. A bone conduction speaker unit, comprising a unit case, incorporating a bone conduction speaker therein with a diaphragm of the bone conduction speaker being exposed, and an earphone jack-mating plug, being disposed in said unit case and being connected to said bone conduction speaker, said plug being slidably provided in a bottom face of said unit case and being connected to an earphone jack in a housing of a mobile phone or other piece of communication equipment to thereby allow said bone conduction speaker unit to be used as a speaker for the piece of communication equipment, wherein said unit case is provided with a fixing plate, opposing to an upper portion of the housing of said piece of communication equipment, and on said fixing plate, an anchoring means for anchoring thereof to the upper portion of said housing is disposed.

* * * * *